US005557813A

United States Patent [19]

Steed et al.

[11] Patent Number: 5,557,813

[45] Date of Patent: Sep. 24, 1996

[54] KNOCK DOWN MATTRESS SYSTEM

[75] Inventors: C. Edward Steed, Alpharetta; Ricky F. Gladney, Fairburn, both of Ga.

[73] Assignee: Simmons Company, Atlanta, Ga.

[21] Appl. No.: 398,227

[22] Filed: Mar. 3, 1995

[51] Int. Cl.[6] ..... A47C 27/00

[52] U.S. Cl. ..... 5/239; 5/717; 5/678

[58] Field of Search ..... 5/400, 451, 452, 5/470, 474, 917

[56] References Cited

U.S. PATENT DOCUMENTS

| | | | |
|---|---|---|---|
| 4,245,363 | 7/1981 | Callaway | 5/475 X |
| 4,394,784 | 7/1983 | Swenson et al. | 5/464 X |
| 4,637,082 | 7/1987 | Moore et al. | 5/452 |
| 4,757,564 | 7/1988 | Goodale | 5/451 |
| 4,879,775 | 11/1989 | Keefer | 5/400 |
| 4,991,244 | 2/1991 | Walker | 5/470 X |
| 5,113,541 | 5/1992 | Johenning . | |
| 5,231,716 | 8/1993 | Johenning . | |

*Primary Examiner*—Michael F. Trettel
*Attorney, Agent, or Firm*—Jones, Day, Reavis & Pogue

[57] ABSTRACT

A knock down mattress system comprises a generally rectangular box-like shell having a bottom panel, a top panel and side panels interposed therebetween. A plurality of generally elongate bolsters are dimensioned and configured to be positioned within the shell in abutment with the side panels thereof. Each bolster comprises a casing containing resiliently compressible, pocketed coil springs, thereby providing a firm but compliant perimeter around the bed. The bolsters are maintained in proper position within the shell by straps which cooperate with loops formed in the bottom panel of the shell. By this configuration, the bolsters define an interior bounded space within the shell to contain a water mattress, an air mattress or other suitable mattress member. Because the bed system comprises an assembly of discrete pieces, it can be shipped conveniently to the customer in disassembled form and is readily assembled at final destination. Suitable vacuum packaging of the mattress components can compress the coil springs making the package of components highly compact in form.

9 Claims, 4 Drawing Sheets

KNOCK DOWN MATTRESS SYSTEM

BACKGROUND OF THE INVENTION

1. Field of the Invention

The present invention relates generally to a knock down mattress system, and it relates more particularly to a mattress system which can be readily assembled and disassembled and which can be conveniently shipped to the consumer in disassembled form.

2. Description of the Prior Art

Conventional beds typically comprise a steel or wood frame on which a box spring is positioned. A mattress is, in turn, placed on the box spring. Beds of this type come in various sizes and can be quite bulky to package and transport.

In recent times, water beds have become popular. A typical water bed comprises a box frame, or coffer, which is designed to contain a plastic water-filled mattress. Because the pressure of the water within the mattress is equal in all directions and the water itself can be quite heavy, a suitable frame for a water bed is usually rather rigid and bulky in order to contain the water-filled mattress. The typical frame, because of its rigid nature, can also be uncomfortable to sit on. Moreover, when sitting on an edge of the bed, the user of the bed can fall backward onto the water mattress if not carefully balanced on the frame. The disadvantages of rigid water bed frames are disclosed, for example, in U.S. Pat. No. 5,231,716 issued to Johenning.

Another known disadvantage of water bed frames is that the hardware used to connect the frame together can puncture the water-filled mattress. The mattress is particularly vulnerable to puncture at its corner seams. One solution to possible mattress puncture is disclosed in U.S. Pat. No. 5,113,541 issued to Johenning which teaches pliant plates for reinforcing the corners of the mattress. However, such structure adds to the cost of producing a water bed mattress.

Accordingly, it is desirable to provide a mattress system which can be used with a water mattress, for example, and which is designed to minimize the possibility of puncturing the water bed mattress without the need for reinforcing members of any kind. It is further desirable to provide a mattress system which does not have a rigid frame but in which the mattress has a firm, compliant perimeter allowing the user to sit on the edge of the mattress comfortably. Still further, it is desirable to provide a mattress system which is assembled from individual pieces and which can be readily shipped in disassembled form using available parcel service companies or the like. Further, it is desirable to provide a mattress system which can be constructed alternatively as either a water mattress, an air mattress, coil spring mattress or a foam mattress, as preferred.

SUMMARY OF THE INVENTION

The present invention overcomes the disadvantages of the prior art by providing a mattress system comprising a generally rectangular shell having a bottom panel, a top panel and side panels interposed therebetween. A plurality of generally elongate bolsters are dimensioned and configured to be positioned within the shell in abutment with the side panels thereof. Each bolster comprises a casing containing resiliently compressible means such as pocketed coil springs, thereby providing a firm but compliant perimeter around the bed. The bolsters are maintained in proper position within the shell by straps connecting them to the bottom panel of the shell. By this configuration, the bolsters define an interior bounded space within the shell to contain a water mattress, an air mattress, or other suitable preferred mattress means. Because the present mattress system comprises an assembly of discrete pieces, it can be shipped conveniently to the customer in disassembled form and is readily assembled at final destination.

BRIEF DESCRIPTION OF THE DRAWINGS

The foregoing and other novel features and advantages of the invention will become apparent upon a reading of the following detailed description taken in conjunction with the accompanying drawings wherein.

DETAILED DESCRIPTION OF THE PREFERRED EMBODIMENTS

Figure 1:
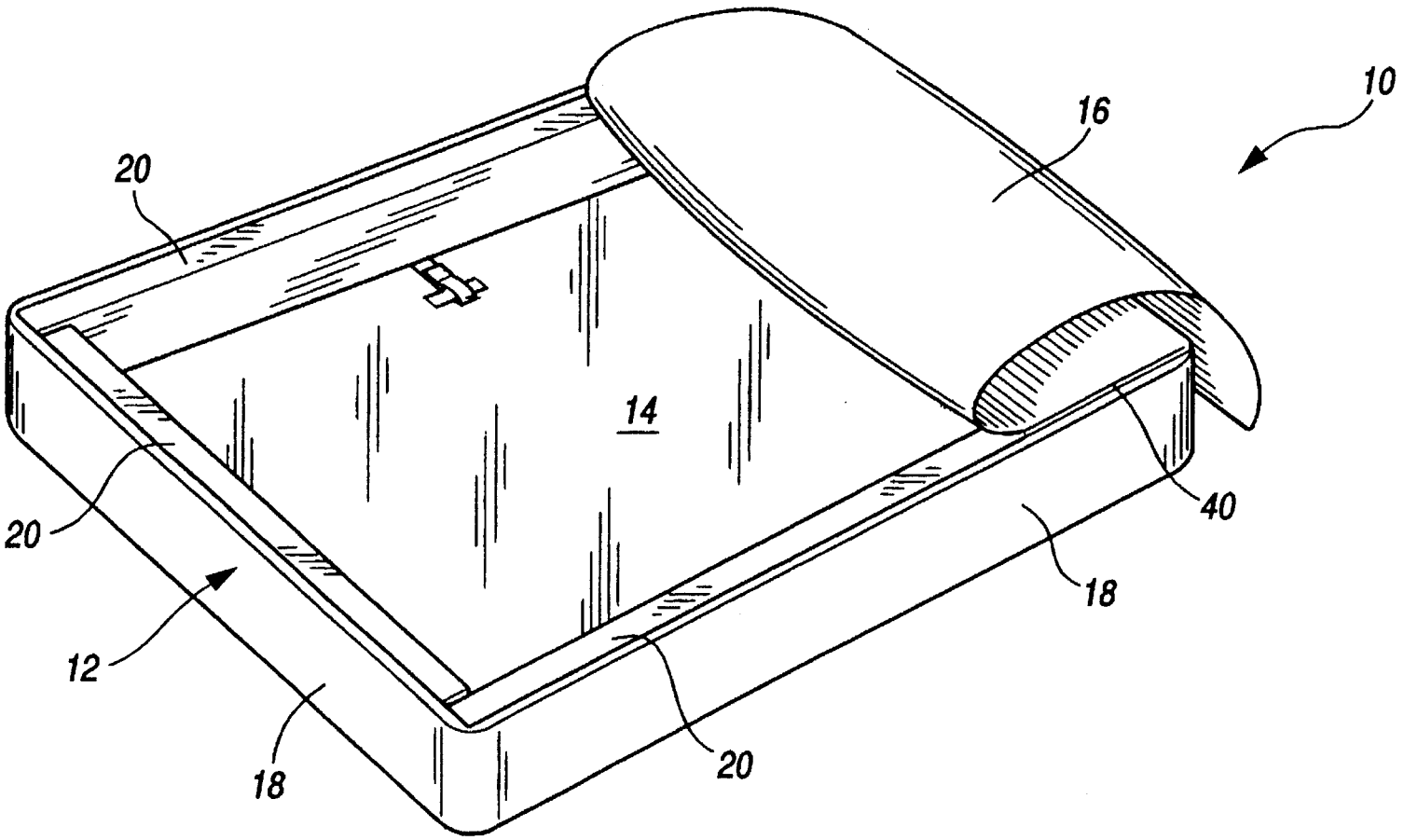
FIG. 1 is a perspective view of a mattress system constructed in accordance with the principles of the invention.

Referring now to the drawings, and initially to FIG. 1, a mattress system in accordance with the invention is designated generally by the reference numeral 10 and includes a generally rectangular box-like shell 12. The shell 12 is preferably constructed of quilted fabric and comprises a bottom panel 14, a top panel 16, shown folded back in FIG. 1, and side panels 18 interposed between the top and bottom panels, 16 and 14, respectively. Four bolsters 20 are positioned within the shell 12 around its periphery and such that the bolsters 20 are in abutment with the side panels 18 of the shell 12.

Figure 2:
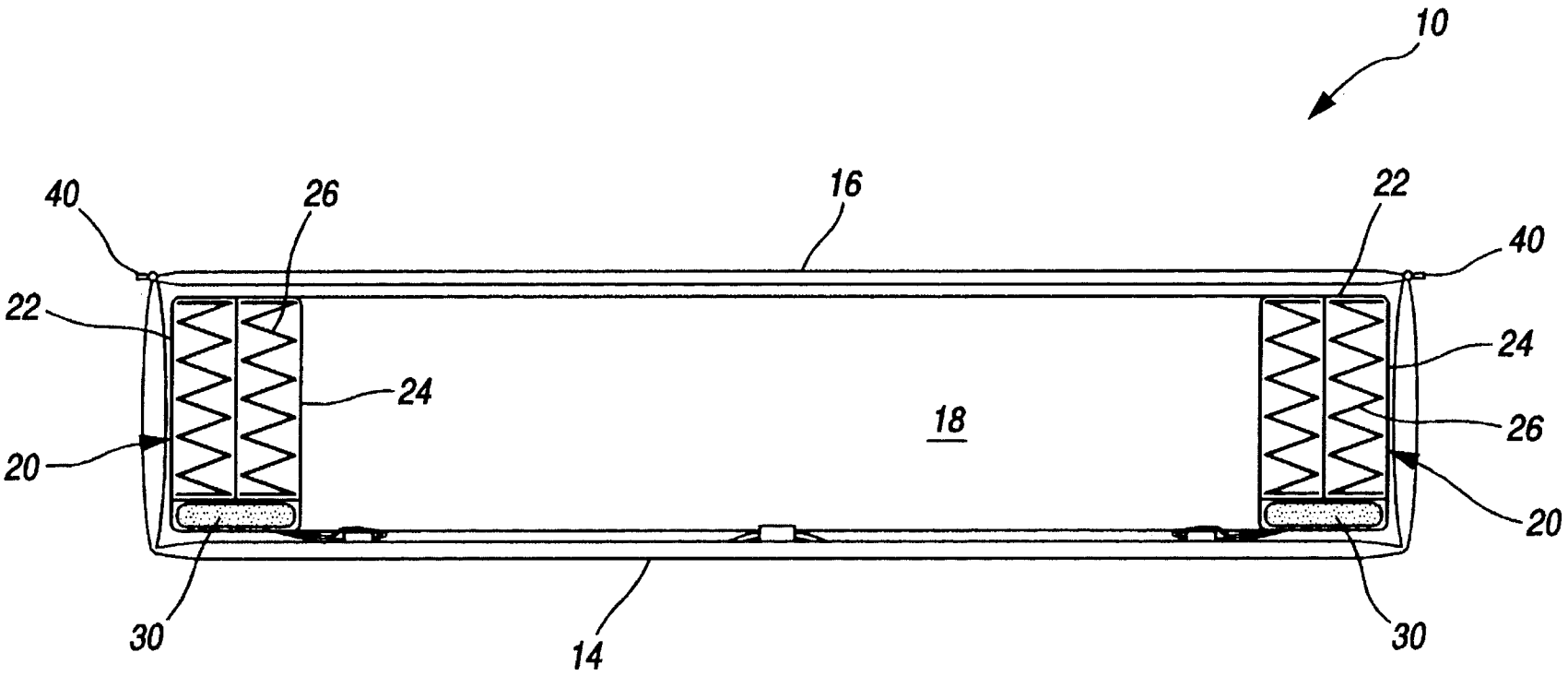
FIG. 2 is a cross-sectional view thereof taken substantially along the line 2—2 of FIG. 1.
Figure 4:
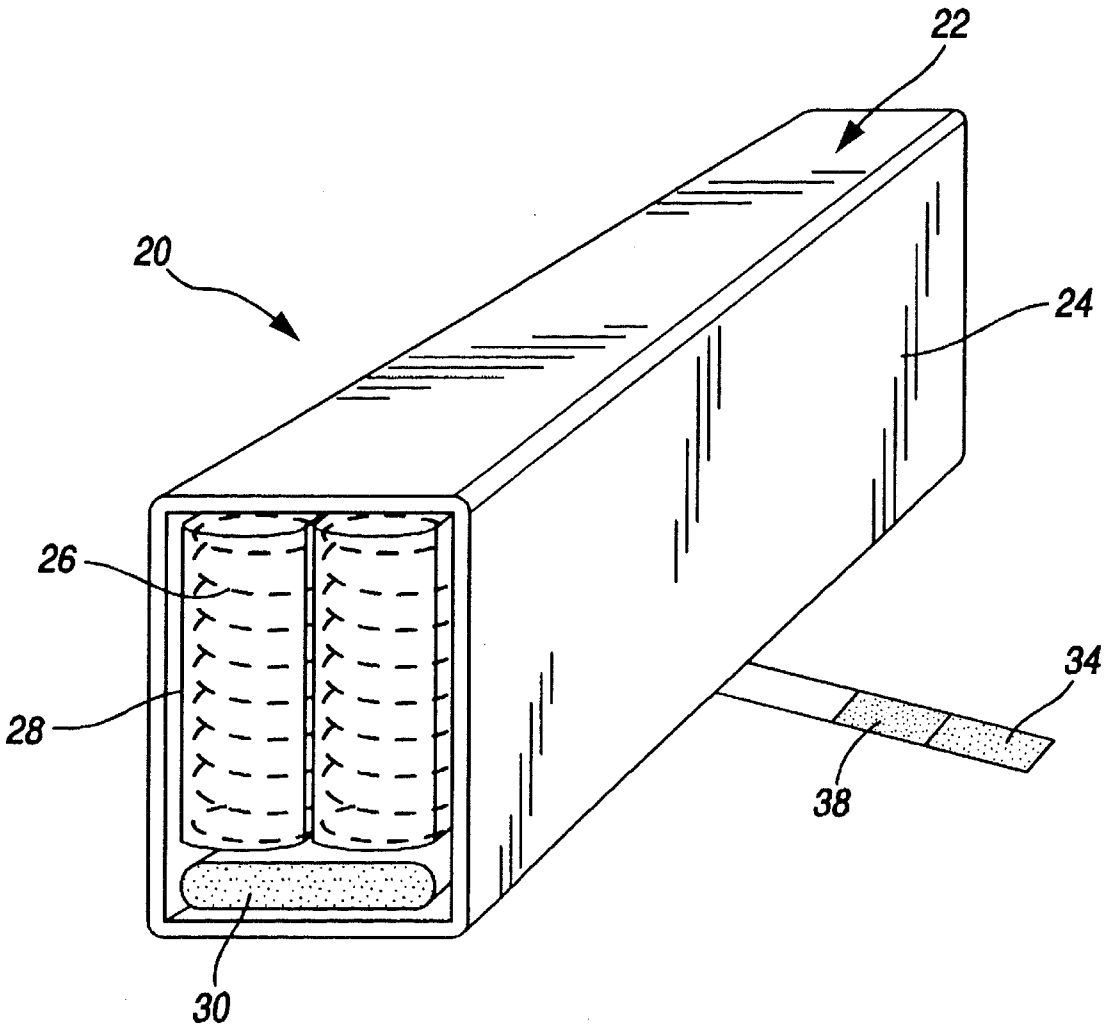
FIG. 4 is a fragmentary perspective view of a bolster constructed in accordance with the invention.

The construction of the bolsters 20 can best be seen in the views of FIGS. 2 and 4. The bolsters 20 are generally elongate members having a rectangular cross-section and comprising a fabric casing 22. Preferably, the casings 22 have side walls 24 which are approximately equal in height to the height of the side panels 18 of the shell 12. Positioned within the casings 22 are strings of coils 26. The coils 26 are constructed of suitable spring steel and in a manner well-known in the mattress art are individually pocketed within fabric sleeves 28 which are welded together to form the strings. Two rows of coils 26 are illustrated in the preferred form of the invention. The coils 26 may be supported by a suitable closed cell foam base pad 30 which runs the length of the bolster 20. For further rigidity of the bolsters 20 an elongate piece of plexiglass may be substituted for the foam pad 30.

Figure 3:
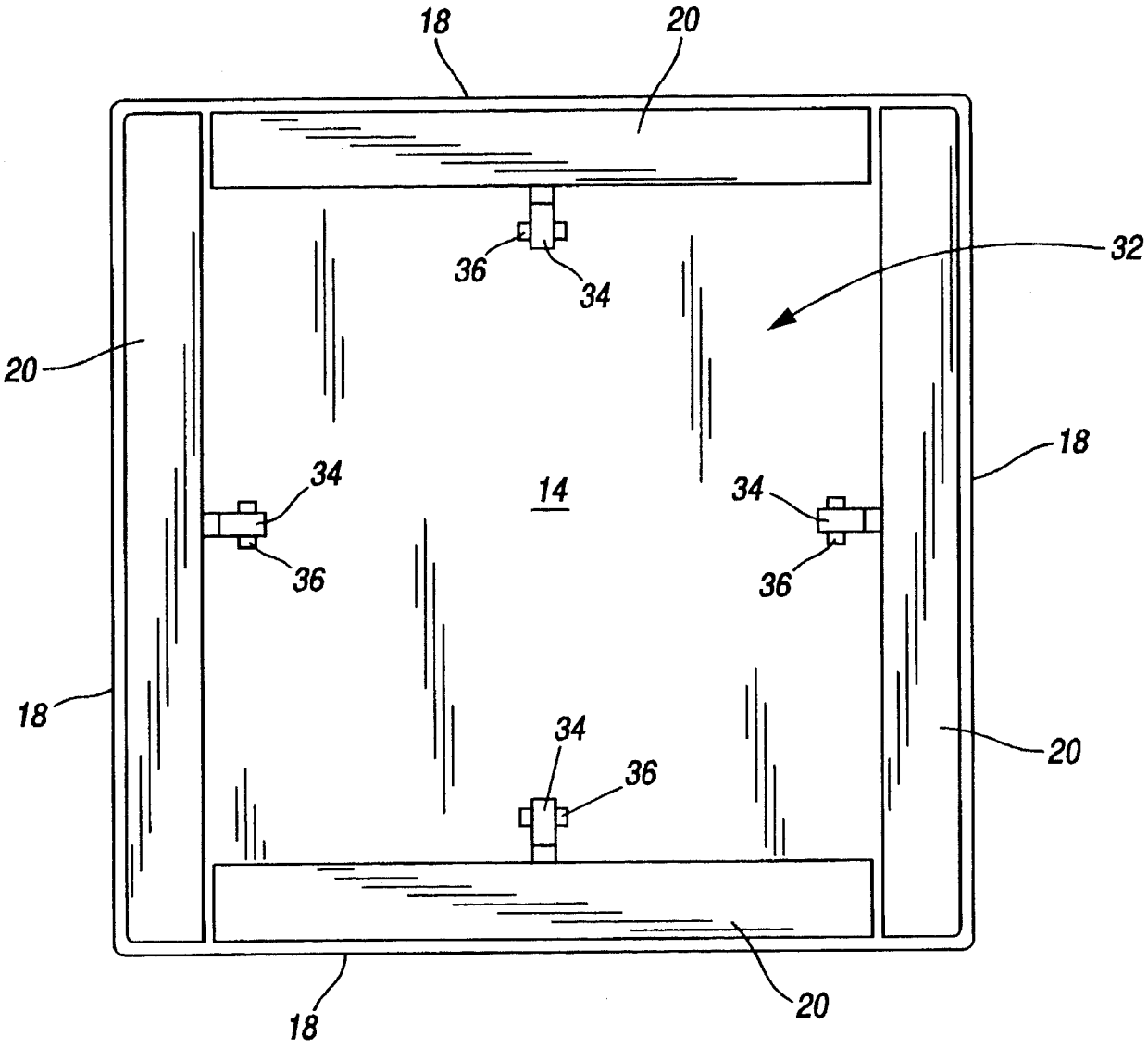
FIG. 3 is a top plan view thereof with the cover removed.

Turning now to FIG. 3, a top plan view of the mattress system 10 is illustrated with the top panel 16 of the shell 12 removed, and shows the four bolsters 20 positioned around the periphery of the shell 12 defining an interior bounded space 32. In accordance with the invention, in order to maintain the bolsters 20 in proper alignment within shell 12, each bolster 20 is provided with a fabric strap 34 sewn to the underside of the casing 22. Preferably, the straps 34 are positioned midway along the length of the bolsters. At positions in registry with the straps 34, the bottom panel 14 of the shell 12 is provided with four fabric loops 36. The straps 34 are inserted through the loops 36 and wrap back around on themselves whereupon they are secured together by suitable hook and loop fastening means 38 (FIG. 4). The underside of the bottom panel 14 of the shell 12 may be reinforced in the area of the loops 36 with fabric patches (not shown).

It can now be appreciated that the mattress system 10 of the present invention provides a highly effective means for constructing a bed which is suitable for use with a water-filled mattress, an air mattress or conventional foam and coil mattress. Because the bolsters 20 comprise two rows of coils 26, they provide a firm but resiliently compressible perimeter for the bed 10. Accordingly, the user of the bed can comfortably sit on the edge of the bed without having to make an effort to balance the weight of the body as is required with use of conventional water beds, for example. Moreover, when the mattress system 10 is used with a water mattress, the bolsters 20 cushion the mattress such that puncturing of the mattress is minimized.

It can also be appreciated that because the mattress system 10 of the present invention is an assembly of discrete pieces, the pieces can be conveniently boxed and shipped in unassembled form by conventional consumer parcel services. A highly compact packaging arrangement can be achieved, for example, by vacuum packaging the various components in a polyethylene sleeve. By this packaging method, the coils 26 of the bolsters 20 can compress to only a fraction of their height. Assembly of the mattress system 10 is readily accomplished by unfolding the shell 12, inserting and strapping the bolsters 20 in proper position within the shell 12 and installing one or more mattress segments within the space 32. The top panel 16 of the shell 12 may then be secured to the side panels 18 by a suitable zipper 40.

While the present invention has been described in connection with preferred embodiments thereof, it will be understood by those skilled in the art that many changes and modifications may be made without departing from the true spirit and scope of the invention. Accordingly, it is intended by the appended claims to cover all such changes and modifications as come within the true spirit and scope of the invention.

What is claimed is:

1. A mattress system comprising:

a shell having a bottom panel, a top panel and side panels interposed therebetween;

a plurality of bolsters dimensioned and configured to be positioned within said shell in abutment with the side panels thereof;

said bolsters each being secured to the bottom panel of said shell by a strap fixed to the underside of said bolster and a cooperative loop member formed on said bottom panel.

2. The mattress system of claim 1 wherein said strap is positioned intermediate the ends of said bolster.

3. The mattress system of claim 1 wherein said bolster comprises a casing and resiliently compressible means within said casing.

4. The mattress system of claim 3 wherein said resiliently compressible means includes a row of metal spring coils.

5. The mattress system of claim 4 wherein said spring coils are each contained within a fabric pocket.

6. The mattress system of claim 5 wherein said pockets are joined together in an elongate string.

7. The mattress system of claim 1 wherein said top panel is secured to said side panels by a zipper.

8. The mattress system of claim 1 wherein said strap comprises hook and loop fastening means.

9. A mattress system comprising:

a shell having a generally rectangular shape in plan and including a bottom panel, a top panel and side panels interposed therebetween;

a plurality of generally elongate bolsters dimensioned and configured to be positioned within said shell in abutment with the side panels thereof, said bolsters having a generally rectangular cross-section with a side wall having a height approximately the height of the side panels of the shell;

a strap fixed to the underside of each bolster at a point midway along the length thereof; and a loop formed on said bottom panel of said shell in registry with said strap;

said strap and loop cooperating to retain said bolster in fixed disposition within said shell.

* * * * *